US009827162B1

(12) United States Patent
Vidmar

(10) Patent No.: US 9,827,162 B1
(45) Date of Patent: Nov. 28, 2017

(54) MOBILE BODY UNWEIGHTED SIT AND STAND CHAIR ASSEMBLY AND METHOD OF OPERATION

(71) Applicant: David J. Vidmar, Ashland, OR (US)

(72) Inventor: David J. Vidmar, Ashland, OR (US)

( * ) Notice: Subject to any disclaimer, the term of this patent is extended or adjusted under 35 U.S.C. 154(b) by 0 days.

(21) Appl. No.: 15/265,440

(22) Filed: Sep. 14, 2016

Related U.S. Application Data

(60) Provisional application No. 62/251,089, filed on Nov. 4, 2015.

(51) Int. Cl.

| | |
|---|---|
| ***A61H 3/04*** | (2006.01) |
| ***A47C 3/22*** | (2006.01) |
| ***A61G 5/14*** | (2006.01) |
| ***A47C 13/00*** | (2006.01) |
| ***A47C 3/18*** | (2006.01) |
| ***A47C 7/00*** | (2006.01) |
| ***A47C 7/48*** | (2006.01) |
| ***A61H 3/00*** | (2006.01) |

(52) U.S. Cl.
CPC ..... *A61H 3/04* (2013.01); *A47C 3/18* (2013.01); *A47C 3/22* (2013.01); *A47C 7/006* (2013.01); *A47C 7/48* (2013.01); *A47C 13/00* (2013.01); *A61G 5/14* (2013.01); *A61H 3/00* (2013.01)

(58) Field of Classification Search
CPC .... A61H 3/04; A47C 3/22; A47C 7/48; A47C 3/18; A47C 13/00; A61G 5/14; A61G 5/124
See application file for complete search history.

(56) References Cited

U.S. PATENT DOCUMENTS

| | | | | | |
|---|---|---|---|---|---|
| 3,912,248 | A * | 10/1975 | Pickford | A47C 3/22 | 248/562 |
| 4,187,869 | A * | 2/1980 | Marchetti | A61H 3/04 | 135/67 |
| 4,429,918 | A * | 2/1984 | Alsup, Jr. | A47C 7/40 | 297/353 |
| 4,650,249 | A | 4/1987 | Serber | | |
| 4,793,655 | A * | 12/1988 | Kvalheim | A47C 9/005 | 297/118 |
| 5,489,258 | A * | 2/1996 | Wohnsen | A61G 5/14 | 280/250.1 |
| 5,520,402 | A * | 5/1996 | Nestor | A61G 5/00 | 280/250 |

(Continued)

*Primary Examiner* — Frank B Vanaman
(74) *Attorney, Agent, or Firm* — Jerry Haynes Law

(57) ABSTRACT

A mobile body unweighted sit and stand chair assembly prevents repetitive stress from sitting, standing, and lifting objects for long periods. The assembly provides a vertically, rotatably, and pivotally adjustable seat, a restrictive support padding that rotates from a support bracket to selectively support the spine or the pelvis, and a frame for structural integrity, mobility, and steering. The seat supports the buttocks and the ischium region of the pelvis, tilting forward up to 35 degrees to abut the pelvis against the support padding. This forward position maintains the spine in a straight posture and forces open posterior intervertebral disc space. The seat is supported by an adjustable rod that supports the weight of user while sitting, walking, kneeling, or lifting. A frame includes wheels that enable mobility and a brake. A first bracket enables feet to steer for hands-free maneuverability. A second bracket provides balance during kneeling and lifting.

19 Claims, 9 Drawing Sheets

(56) References Cited

U.S. PATENT DOCUMENTS

| | | | | |
|---|---|---|---|---|
| 5,702,326 | A * | 12/1997 | Renteria | A61H 3/04 135/67 |
| 5,791,733 | A | 8/1998 | van Hekken et al. | |
| 5,961,179 | A | 10/1999 | Dixon et al. | |
| 6,343,802 | B1 | 2/2002 | Workman et al. | |
| 6,866,340 | B1 | 3/2005 | Robertshaw | |
| 7,350,863 | B2 | 4/2008 | Engels et al. | |
| 7,367,623 | B2 | 5/2008 | Tholkes et al. | |
| 2007/0246990 | A1 * | 10/2007 | Grenon | A47C 3/18 297/411.31 |
| 2011/0278809 | A1 * | 11/2011 | Turner | A61H 3/04 280/47.35 |
| 2012/0000496 | A1 * | 1/2012 | Razon | A61H 3/04 135/67 |
| 2013/0331993 | A1 | 12/2013 | Detsch et al. | |
| 2015/0075575 | A1 * | 3/2015 | Karlovich | A63B 69/0064 135/66 |

* cited by examiner

MOBILE BODY UNWEIGHTED SIT AND STAND CHAIR ASSEMBLY AND METHOD OF OPERATION

CROSS REFERENCE OF RELATED APPLICATIONS

This application claims the benefits of U.S. provisional application No. 62/251,089 filed Nov. 4, 2016 and entitled MOBILE BODY UNWEIGHTED SIT AND STAND CHAIR ASSEMBLY, which provisional application is incorporated by reference herein in its entirety.

FIELD OF THE INVENTION

The present invention relates generally to a mobile body unweighted sit and stand chair assembly and method of operation that is used to support the lower back through weight alleviation. More so, the present invention relates to an ergonomic assembly that supports the lower back and alleviates weight on the legs by providing an adjustable seat, a restrictive support padding, and a mobile frame that work together to maintain the pelvic region and the lower back in an aligned, comfortable position that opens intervertebral disc spacing while also alleviating weight on the legs, such that a user can perform normal workstation activities while sitting, standing, bending, crawling, walking, and climbing with comfortable positioning of the lower back, alleviation of weight on the legs, and hands free steering and braking of the assembly; whereby the assembly enables standing and walking without bodyweight, thereby eliminating the pain and damage caused by gravity in the workplace.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, ergonomics is the practice of designing products, systems, or processes to take proper account of the interaction between them and the people who use them. Physical ergonomics is concerned with human anatomy, and some of the anthropometric, physiological and bio mechanical characteristics as they relate to physical activity. Certain jobs or work conditions cause a higher rate of worker complaints of undue strain, localized fatigue, discomfort, or pain that does not go away after overnight rest. These types of jobs are often those involving activities such as repetitive and forceful exertions; frequent, heavy, or overhead lifts; awkward work positions; or use of vibrating equipment. Often, office jobs create the greatest amount of injury to the lower back, spine, and legs, due to the repetitive nature of the tasks.

The typical office related chair is comprised of a seat of about 17", but often up to 20" or more, such that the user bears weight on the buttocks and ischia as well as the thighs. Such a design, however, puts pressure on the user's thighs and calves, affecting circulation to the legs and feet, and creating discomfort for the user. Further, the lumbar spine is encouraged into a position of extreme flexion known to create disc pathology, another source of much pain and lost work time. Efforts have been made to design ergonomic chairs that can at least partially offset these anatomical issues, and also to be more adjustable.

It is known that an ergonomic chair is designed ergonomically to distribute the weight of the occupant to various parts of the body. For example, a seat that is higher results in dangling feet and increased pressure on the underside of the knees. It may also result in no weight on the feet which means more weight elsewhere. A lower seat may shift too much weight to the seat bones. Generally, a reclining seat and back will shift weight to the occupant's back. This may be more comfortable for some in reducing weight on the seat area, but may be problematic for others who have bad backs. In general, if the occupant is supposed to sit for a long time, weight needs to be taken off the seat area and thus easy chairs intended for long periods of sitting are generally at least slightly reclined. Reclining may not, however, be suitable for chairs intended for work or eating at table. Thus, the ergonomic chair is also adjustable to accommodate for such deficiencies.

It is recognized that the ergonomic chair is not, however, always conducive to maintaining a proper posture while sitting at a workstation, walking between workstations, or picking up objects. Consequently, the spine may not be forced into the proper alignment. This is problematic because the spine has a proclivity to relax in a slightly slouched position, and consequently, the pelvic tilts forward. Generally, the curved nature of the spine in this slouched position may create stress on the lower back and the neck, especially after long durations and repetitive movements at the workstation. After a duration, this may result in spinal problems, lower back pain, sciatic nerve pain, general neck and spine pain, and sore legs—conditions that are not conducive to productivity and time at the workstation.

Other proposals have involved ergonomic chairs designed for repetitive tasks. The problem with these is that they are not conducive to sitting, standing, walking, bending, and climbing functions. Also, the lower back or the pelvis cannot be supported independently of each other to enhance support of the lower back and maintain the spine in a straight posture and create spacing between the posterior intervertebral discs. Even though the above cited ergonomic devices meets some of the needs of the market, a mobile body unweighted sit and stand chair assembly and method of operation that is used to support the lower back through weight alleviation is still desired.

SUMMARY

Illustrative embodiments of the disclosure are generally directed to a mobile body unweighted sit and stand chair assembly and method of operation. The assembly helps prevent repetitive stress that often occur when sitting, standing, crawling, climbing, and lifting for long periods. The assembly provides an adjustable seat, a rotatable support padding, and an adjustable rod that work together to create adjustable support to the buttocks, lower back, and pelvis. In this manner, a user can move and operate at a workstation, in a substantially unweighted manner.

The assembly provides a frame that allows for structural integrity, mobility, and steering of the assembly. The assembly further includes an adjustable seat for supporting the buttocks, and thereby a substantial amount of the weight of the user. The seat is adjustable to extend, retract, pivot, and rotate to both support the buttocks, and orient the lower back or pelvis towards a support padding. The seat works in conjunction with the support padding to enhance the supportive features of the assembly. An adjustable rod supports the seat to create evenly balanced, purely vertical platform motion that provides an unweighted feel.

A generally L-shaped support bracket extends from the adjustable rod, terminating at the support padding. The support bracket pivots and rotates up to 360° to selectively enable the support padding to engage both the lower back and spine, and the pelvis. The support padding is rigid, yet comfortable. In a rear position, the support padding supports the spine and lower back to help straighten the posture and prevent slouching. The support of the spine enables normal chair operations through lower back support. Support for the lower back is useful for sitting or lifting functions.

The support bracket may also rotate the support padding to a forward position for support of the pelvis, so as to straighten the spine and force open posterior intervertebral disc space along the spine. This unique support of the pelvis forces the spine forward to enhance posture while sitting, standing, walking, and lifting. Support for the pelvis is useful for standing, bending, or climbing functions. Thus, the support padding and the seat are sufficiently adjustable to provide support for various workstation or workplace activities. The support padding and seat are also adjustable to accommodate different parts of the body, and different body sizes and shapes.

The assembly is also mobile and steerable. At least one wheel on the frame enable mobility. At least one brake inhibit rotation of the wheel and create a bracing effect for turning and rotating the assembly. Unique brackets operatively join with the frame to enable the feet to steer the assembly. The overall effect created by the assembly is an adjustable, unweighted chair that facilitates movement while a user is sitting at a workstation, standing at a workstation for a long duration, climbing a slope, crawling on the ground, and lifting objects. This flexibility to accommodate multiple motions alleviates repetitive stress to the back and lower body for myriad operations a user may be performing.

In one possible embodiment, the assembly provides a frame. The frame allows for structural integrity, mobility, and steering of the assembly. The assembly further provides a vertically, rotatably, and pivotally adjustable seat. The assembly further provides a restrictive support padding that rotates to selectively support the back or the pelvis. The seat supports the buttocks and the ischium region of the pelvis, tilting forward up to 35 degrees to abut the pelvis against the support padding, and towards a workstation from a sitting or standing position. Thus, when the seat is in the forward tilted disposition and the support padding is fully engaged with the pelvis area, the spine is maintained in a straight posture and spacing is created between the posterior intervertebral discs.

The seat is supported by an adjustable rod that supports a substantial amount of the weight of the user while sitting, walking, kneeling, or lifting. The adjustable rod raises, lowers, and rotates to adjust the seat accordingly. A locking tube receives the adjustable rod. The adjustable rod and the locking tube slidably articulate to create lift assist motion and evenly balanced, purely vertical platform motion. A restriction bar inhibits rotation of the adjustable rod, and consequently the seat. When the seat is prevented from rotating, there is sufficient leverage to enable the assembly to be steered to the left, right, and rotated.

Protruding in an arc shape from the frame, a first bracket enables feet to steer for hands-free maneuverability. Parallel to the first bracket, a second bracket provides balance during kneeling, bending, and lifting. At least one wheel on the frame enables mobility of the assembly. At least one brake selectively engages the wheel to inhibits rotation of the wheel and provide leverage for turning, rotating, and steering the assembly.

In one embodiment, the assembly comprises a frame defined by a substantially U-shape having a closed end and an open end. The open end enables free movement of the feet for steering and mobility. Though the feet may face either the open or closed ends. A first bracket, having a generally arced shape, is configured to traverse the closed end of the frame. A second bracket, having a generally arced shape, is configured to traverse the open end of the frame. The brackets are configured to enhance the structural integrity of the assembly. The brackets are also configured to engage the lower body, so as to brace the assembly during steering. A bridge may be used to connect the first bracket and the second bracket.

The assembly further comprises an adjustable rod. The adjustable rod is defined by a mount end and a seat end. The adjustable rod is disposed in a generally perpendicular relationship with the frame. The adjustable rod is configured to selectively extend and retract relative to the frame, and also to rotate about an axis. The adjustable rod is received inside a locking tube. The adjustable rod and the locking tube slidably articulate to form a coordinated gas spring rod that creates lift assist motion and evenly balanced, purely vertical platform motion. This enhances the unweighted feel of the assembly.

A seat joins the seat end of the adjustable rod. The seat is configured to enable at least partial support of the buttocks and the ischium region of the pelvis. The seat pivots about the seat end of the adjustable rod to enable forward and rearward tilting up to 35°. Because the adjustable rod is extendable and retractable, the seat may be selectively raised and lowered to a desired height. Because the adjustable rod rotates about an axis, the seat may also rotate.

The assembly further comprises a restriction bar that is disposed in a generally perpendicular relationship with the frame, and a generally parallel relationship with the adjustable rod. The restriction bar selectively inhibits rotation of the adjustable rod about the axis. In this manner, the seat is also restricted from rotating, which creates a brace, or leverage, for steering the assembly.

The assembly further comprises a support bracket that is defined by a generally L-shape having a proximal end and a distal end. The proximal end of the pelvis support bracket joins with the seat end of the adjustable rod. The support bracket is configured to selectively extend and retract relative to the adjustable rod in a lateral motion. The support bracket is also configured to rotate about the adjustable rod 360°.

A support padding joins with the distal end of the support bracket. The support padding pivots about the distal end of the support bracket. Thus, through lateral and pivotal manipulations of the support padding, the back may be more comfortable supported, and the spine is maintained in a straight posture and spacing is created between the posterior intervertebral discs.

Thus because of the rotational functionality of the support bracket, the support padding may rotate for engagement with the back and the pelvis. Also because of the pivoting functionality of the support bracket, the support padding may pivot against the back and the pelvis. Further, the seat is extendable and retractable, so as to selectively position the support padding at a desired region of the back or pelvis.

As discussed above, the assembly also enables mobility and steering. At least one wheel on the frame is configured to enable mobility of the assembly. The wheels may roll forward, backwards, or rotate 360°. At least one brake is configured to at least partially restrict movement of the at least one wheel. With the brake applied and the seat inhibited from rotation, the feet may manipulate the frame and the brackets to steer the assembly.

One objective of the present invention is to provide a mobile body unweighted sit and stand chair assembly that helps prevent repetitive stress from sitting, standing, crawling, climbing, and lifting functions for long periods by supporting the buttocks and pelvis.

Another objective is to provide sufficient support, such that a user is unweighted while sitting at a workstation, standing at a workstation for a long duration, climbing a slope, crawling on the ground, and lifting objects.

Another objective is to enable 360° rotation of the support padding to selectively support the back and the pelvis.

Another objective is to enable titling of the support padding to adjust the pelvis to a desired alignment.

Another objective is to enable adjustable raising and lowering of the seat to position the support padding at a desired position on the back or pelvis.

Another objective is to straighten the back with a support padding that rotates to support the back.

Another objective is to maintain the spine in a straight posture and create spacing between the posterior intervertebral discs with the support padding.

Yet another objective is to provide an adjustable rod and a locking tube comprising a coordinated gas spring rod that is implemented in a novel way so as to create lift assist motion and evenly balanced, purely vertical platform motion.

Yet another objective is to provide a first bracket and a second bracket across the frame to assist in steering the assembly.

Yet another objective is to provide a restriction bar that restricts rotation of the adjustable rod.

Yet another objective is to provide at least one brake for restricting mobility and helping in steering by providing a brace against the ground surface.

Yet another objective is to customize that assembly for an individual basis, depending on the specific weight or size of a user.

Yet another objective is to provide an inexpensive to manufacture and easy to operate mobile body unweighted sit and stand chair assembly.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
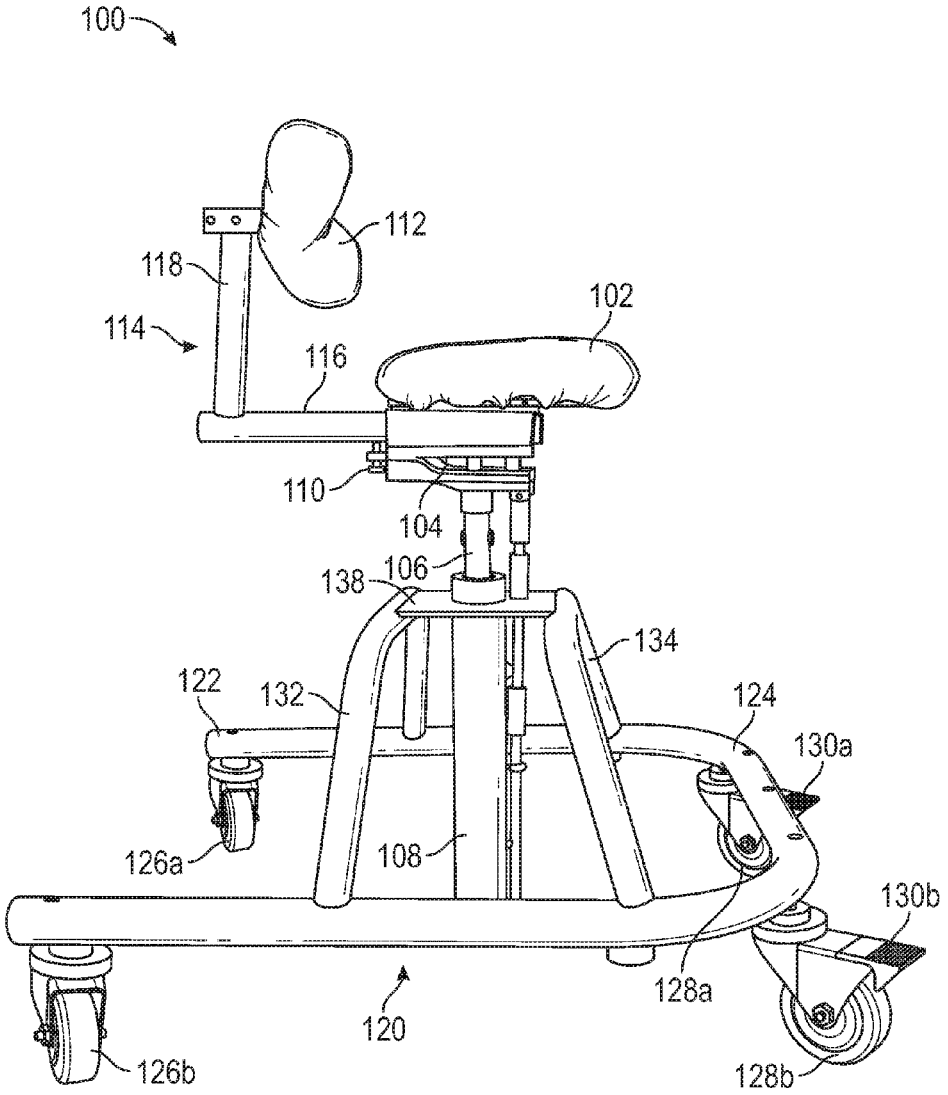
FIG. 1 illustrates a perspective view of an ergonomic chair assembly, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A mobile body unweighted sit and stand chair assembly 100 and method 300 of operation is referenced in FIGS. 1-9. The mobile body unweighted sit and stand chair assembly 100, hereafter "assembly 100", helps prevent repetitive stress that often occur when sitting, standing, crawling, climbing, and lifting for long periods. The assembly provides adjustable support to the buttocks 210, the lower back 204, and the pelvis 206, such that a user can move and operate at a workstation, in a substantially unweighted manner.

The assembly provides an adjustable seat 102 for supporting the buttocks 210, and thereby a substantial amount of the weight of the user. The seat 102 is adjustable to extend, retract, pivot, and rotate to not only support the buttocks 210, but also to orient the lower back 204 or pelvis 206 towards a support padding 112. The seat 102 works in conjunction with the support padding 112 to enhance the supportive features of the assembly 100. An adjustable rod 106 supports the seat 102 and creates lift assist motion and evenly balanced, purely vertical platform motion. A generally L-shaped support bracket 114 extends from the adjustable rod 106, terminating at the support padding 112. The support bracket 114 rotates up to 360° to selectively enable the support padding 112 to engage both the lower back 204 and the spine 208, or the pelvis 206, depending on the direction that the support bracket 114 is rotated towards.

When positioned to support the lower back 204 and spine 206, the support padding 112 helps straighten the posture and prevent slouching of the user. The support of the spine 208 also enables normal workstation operations through enhanced lower back support. Support for the lower back 204 is useful for sitting and lifting functions. Further, the support padding 112 also tilts to further enhance support of the lower back 204.

When rotated to position against the pelvis 206, the support padding 112 helps straighten the spine 208 and force open posterior intervertebral disc space along the spine 208. Thus, support of the pelvis 206 forces the spine 208 forward in a slightly rounded posture to enhance posture while sitting, standing, walking, and lifting. Support for the pelvis 206 is useful for standing, bending, or climbing functions. Further, the support padding 112 also tilts to further enhance support of the pelvis 206. Thus, the support padding 112 and the seat 102 are sufficiently adjustable to provide support for various workstation or workplace activities. The support padding 112 and seat 102 are also adjustable to accommodate different parts of the body, and different body sizes and shapes.

The assembly 100 is also mobile and steerable. The frame 120 has an open end 128 that enables free movement of the feet for desired manipulation of the assembly 100. At least one wheel 126*a-b*, 128*a-b* on the frame 100 enables mobility. At least one brake 130*a-b* selectively engages the wheel 126*a-b*, 128*a-b* to inhibit rotation of the wheel 126*a-b* and create a bracing effect for turning and rotating the assembly 100. Unique brackets 132, 134 operatively join with the frame 120, providing a bracing effect to enable the feet and calves to steer the assembly 100.

The overall effect created by the assembly 100 is an adjustable, unweighted ergonomic chair that facilitates movement while a user is sitting at a workstation, standing at a workstation for a long duration, bending, climbing a slope, crawling on the ground, and lifting objects. This flexibility to accommodate multiple motions while remaining attached to the user alleviates repetitive stress to the back and lower body for a variety of workstation-related functions.

As FIGS. 2-8 illustrate, the assembly 100 is configured to help support the lower back 204 and alleviate weight on the legs while sitting, standing, bending, crawling, and lifting. The assembly 100 provides a tilt angle adjustable seat 102, a restrictive support padding 112, and a mobile frame 120 that work together to prevent repetitive stress injury and back pain associated with sitting, standing, crawling, and lifting objects for long periods.

In one embodiment, the assembly 100 is configured to create a body unweighting effect to 100%. The assembly 100 also provides specific support to regions of the body that are susceptible to prolonged or rigorous sitting and standing positions at a workstation, such as the lower back 204 and legs. The assembly 100 is also mobile and steerable to allow weight supported walking to 5 mph while providing the ergonomic support advantageous.

In other embodiments, the assembly 100 may enable a user to comfortably function at a workstation with minimal discomfort to the lower back 204 while in a sitting or standing position. The assembly 100 also helps alleviate up to 100% the weight of the user from the legs while standing, walking, kneeling, or picking up an object with minimal discomfort.

Furthermore, the assembly 100 remains attached to the user during walking or scooting movement and allows for hands free steering and braking. In this manner, a user can perform normal movements at a workstation from a sitting, standing, kneeling, walking, stair climbing, and lifting position.

As illustrated in FIG. 1, the assembly provides a generally U-shaped frame 120 defined by an open end 122 and a closed end 124. The frame 120 enables structural integrity, mobility, and steering of the assembly 100. At least one wheel 126*a-b*, 128*a-b* attaches to the ends 122, 124 of the frame 120 to enable mobility of the assembly 100. At least one brake 130*a-b* selectively engages the wheel 126*a-b*, 128*a-b* to inhibit rotation of the wheel 126*a-b*, 128*a-b* and provide leverage for turning, rotating, and steering the assembly 100. A first bracket 132 enables feet to steer for hands-free maneuverability. A second bracket 134 provides balance during kneeling, bending, and lifting.

The assembly 100 further provides a vertically, rotatably, and pivotally adjustable seat 102. The seat 102 supports the buttocks 210 and the ischium region of the pelvis 206. In one embodiment, the seat 102 is configured to pivot. In one exemplary use of this pivoting function, the seat 102 may tilt forward up to 35° to abut the pelvis 206 against the support padding 112, and towards a workstation from a sitting or standing position. Thus, in this forward tilted disposition, the spine 208 is maintained in a straight posture and spacing is created between the posterior intervertebral discs. In other embodiments however, the seat 102 may tilt back in an opposite direction, as desired. The seat 102 is also configured to rotate, extend, and retract, as described below.

The seat 102 is supported by an adjustable rod 106 that supports a substantial amount of the weight of the user while sitting, walking, kneeling, or lifting. The adjustable rod 106 extends and retracts relative to the frame 120 to enable height adjustment of the seat 102. The adjustable rod 106 also rotates to orient the user in a desired supportive direction against the support padding 112. A restriction bar 136 inhibits rotation of the adjustable rod 106, and thereby the seat. This rotational restriction creates a bracing effect that facilitates steering of the assembly 100.

Looking again at FIG. 1, the frame 120 is defined by a substantially U-shape having a closed end 124 and an open end 122. The open end 122 enables free movement of the feet for steering and mobility. Though the feet may also have generally free movement facing the closed end 124. A first bracket 132, having a generally arced shape, is configured to traverse the closed end 124 of the frame 120. A second bracket 134, having a generally arced shape, is configured to traverse the open end 132 of the frame 120. The brackets 132, 134 are configured to enhance the structural integrity of the assembly 100. The brackets 132, 134 are also configured to engage the lower body, so as to brace the assembly 100 during steering. A bridge 138 may be used to connect the first bracket 132 and the second bracket 134.

As described above, the frame 120 has a generally U-shape that creates space for the feet to rest comfortably while sitting or standing in a forward direction and the space for rearward movement of the legs while walking in the assembly 100. The frame 120 includes at least one forward wheel 126*a-b* and at least one rear wheel 128*a-b* that enable movement of the assembly 100 and the user in multiple planar directions.

Figure 5:
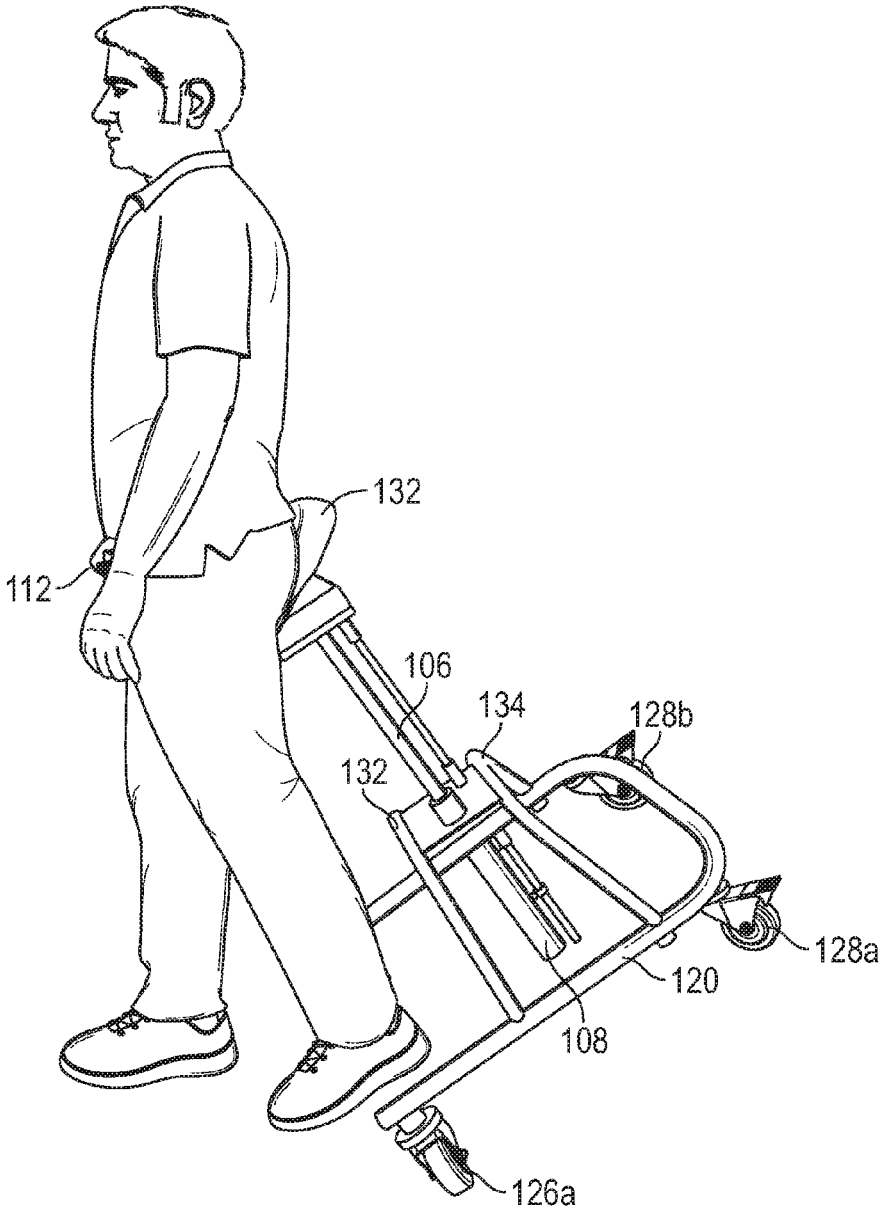
FIG. 5 illustrates a perspective view of a user walking with an attached ergonomic chair assembly supporting a substantial portion of the user's weight, in accordance with an embodiment of the present invention.

The forward and rear wheels 126*a-b*, 128*a-b* allow a user to manually maneuver the assembly 100 by pushing off with the feet from the sitting or standing position. At least one brake 130*a-b* may position at any of the wheels 126*a-b*, 128*a-b*. The brake 130*a-b* is configured to restrict movement of the affected wheels 126*a-b*, 128*a-b* and provide leverage for rotating, turning, and general manipulation of the assembly 100. In this manner, the frame 120 may be oriented or pivoted in a desired direction while operating in a workstation. As illustrated in FIG. 5, the assembly 100 enables the user to walk, such that only the forward wheel 126*a-b* engages the ground surface and the rear wheel 128*a-b* is lifted above the ground surface. This is especially effective when climbing stairs or traversing an uneven ground surface.

Figure 6:
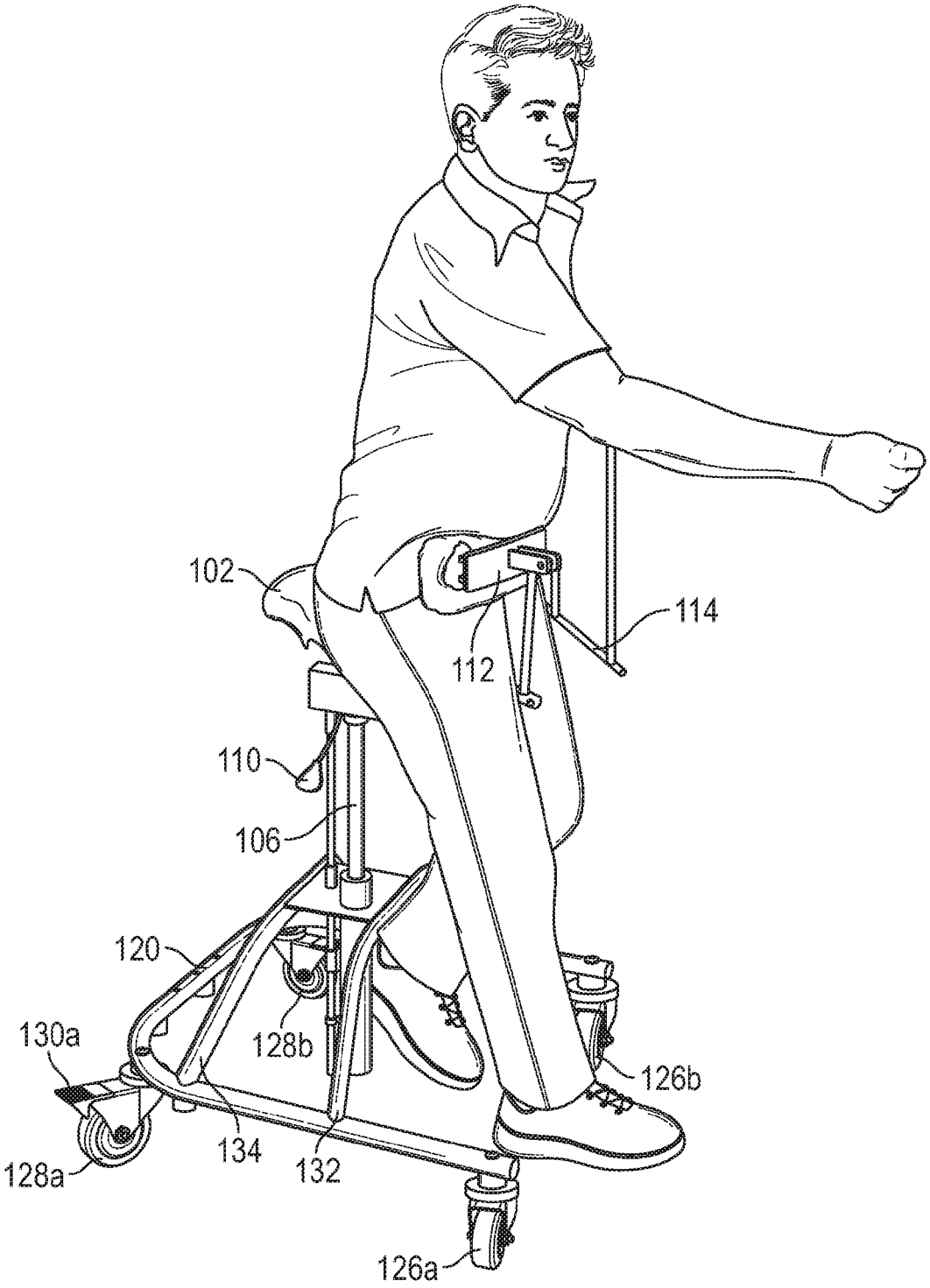
FIG. 6 illustrates a perspective view of a user walking with an attached ergonomic chair assembly and steering the assembly with the calf of leg engaging a front bracket, in accordance with an embodiment of the present invention.

The first bracket 132 enhances the structural integrity of the frame 120. The first bracket 132 also enables steering of the assembly 100 while moving on the wheels 126*a-b*, 128*a-b*. The steering is achieved by anchoring the calf against either end of the first bracket 132 to pivot in the desired direction. FIG. 6 references the left calf restricting movement of one end of the first bracket 132, such that the assembly 100 is steered to the left. In this manner, the user may steer the assembly 100 to the desired area while maintaining freedom of hands.

The second bracket 134 also enhances the structural integrity of the frame 120. The second bracket 134 helps balance the assembly 100 when the user is leaning forward. This may be especially useful when the user bends down to pick up an object, as referenced in FIG. 7. Here, the second bracket 134 helps maintain lateral and rear balance to the frame 120, such that the user does not tip over.

The assembly 100 further comprises an adjustable rod 106. The adjustable rod 106 is defined by a mount end and a seat end. The adjustable rod 106 is disposed in a generally perpendicular relationship with the frame 120. In one embodiment, the adjustable rod 106 passes through a hole in the bridge 138. The adjustable rod 106 is configured to selectively extend and retract relative to the frame 120, and also to rotate about an axis. In one possible embodiment, the adjustable rod 106 is received inside a locking tube 108. The adjustable rod 106 and the locking tube 108 form a coordinated gas spring rod that creates lift assist motion and evenly balanced, purely vertical platform motion. This enhances the unweighted feel of the assembly 100.

The adjustable rod 106 supports the seat 102 while also selectively raising and lowering the seat 102 to a desired height. For example, the adjustable rod 106 may lower to create a sitting position, or raise to operate from a standing position. In one embodiment, the adjustable rod 106 is configured to help dampen weight and shock from the user. The seat 102 also pivots about the adjustable rod 106. The adjustable rod 106 is easily adjustable to accommodate the seat 102 for workstations of varying heights and dimensions, such as standard desks/tables, standing desks, and drawing tables.

The seat 102 joins the seat 102 end of the adjustable rod 106. The seat 102 is configured to enable at least partial support of the buttocks 210 and the ischium region of the pelvis 206. The seat 102 pivots about the seat 102 end of the adjustable rod 106 to enable forward and rearward tilting up to 35°. Because the adjustable rod 106 is extendable and retractable, the seat 102 may be selectively raised and lowered to a desired height for comfort of the user. Because the adjustable rod 106 rotates about an axis, the seat 102 may also rotate.

The seat 102 supports the weight of the user and/or an object from a sitting, walking, kneeling, or lifting position. The seat 102 is height adjustable from sitting to standing positions, can tilt or pivot through an arc to allow supported work above the uses head or down below for prolonged periods. The adjustable configuration of the seat 102 helps a user perform functions at variable height workstations for long durations with minimal stress on the lower back 204 and hips/legs.

The adjustable rod 106 also conforms to accommodate the seat 102 for workstations of varying heights and dimensions, such as standard desks/tables, standing desks, and drawing tables. For example, a clerk at a computer station can sit and type at a slightly forward tilt while maintaining a generally upright posture, which reduces stress on the spine 208 and lower back 204 by reducing excess lumbar curve and opening posterior intervertebral disc space to release disc pressure on sciatic nerves 204. An airplane mechanic can work at awkward overhead angles on the wing of an airplane without torqueing the spine 208. A surgeon can sit and stand while leaning over at the bedside of a patient for long durations while performing surgery.

In another example, a cashier can stand at the register and move away to bag and return for the whole day without body weight causing pain in legs, feet, hips while pelvis 206 is stabilized allowing the spine 208 to avoid common excessive lordotic and/or kyphotic curve in the lumbar region common to people with chronic stenosis and back pain. A mover can stand, walk, and kneel to carry loads to and from a truck while alleviating weight on the legs with a stabilized pelvis 206 and straight spine 208. Those skilled in the art will further recognize that a general reduction in back pain and lower extremity pain with the ability to walk without body weight will clearly allow many workstation uses to tolerate prolonged times at that station without the need for relief.

The assembly 100 further comprises a restriction bar 136 that is disposed in a generally perpendicular relationship with the frame 120, and a generally parallel relationship with the adjustable rod 106. The restriction bar 136 selectively inhibits rotation of the adjustable rod 106 about the axis. In this manner, the seat 102 is also restricted from rotating, which creates a brace, or leverage, for steering the assembly 100. By restricting rotation in this manner, the restriction bar 136 forces all turning or rotation into at least one first bracket 126*a-b*, i.e., steering components on the calves or onto the feet. In one operational embodiment, without the restriction bar 136 operating to restrict rotation of the seat 102, the assembly 100 may not be steerable.

The assembly 100 further comprises a support bracket 114 that is defined by a generally L-shape having a proximal end 116 and a distal end 118. The proximal end 116 of the support bracket 114 joins with the seat end of the adjustable rod 106. The support bracket 114 is configured to selectively extend and retract relative to the adjustable rod 106 in a lateral motion. The support bracket 114 is also configured to rotate about the adjustable rod 106 360°.

The assembly 100 further provides a restrictive support padding 112 that rotates from a support bracket 114 to selectively support the lower back 204 and spine 208, or the pelvis 206. The support padding 112 joins with the distal end 118 of the support bracket 114. In one embodiment, the support padding 112 pivots about the distal end 118 of the support bracket 114. Thus, through lateral and pivotal manipulations of the support padding 112, the lower back 204 and spine 208 may be more comfortable supported, and the spine 208 is maintained in a straight posture and spacing is created between the posterior intervertebral discs.

In addition to pivoting, the support padding 112 also rotates about the adjustable rod 106 to enable selective forward and rearward positioning relative to the user. In the rearward direction, the support padding 112 supports the lower back 204 and spine 208. In the forward direction, the support padding 112 is generally aligned with the pelvis 206 of the user.

Thus because of the rotational functionality of the support bracket 114, the support padding 112 may rotate for engagement with the back and the pelvis 206. Also because of the pivoting functionality of the support bracket 114, the support padding 112 may pivot against the back and the pelvis 206. Further, the seat 102 is extendable and retractable, so as to selectively position the support padding 112 at a desired region of the back or pelvis 206. Further, the support padding 112, can slip forward, twist toward the floor, rotating the support padding, essentially moving out of the path of the user for unrestricted ease of exiting or entering the assembly 100.

It is significant to note that the assembly 100 does not utilize both a back rest and a pelvis support simultaneously. Thus, by not utilizing a back rest, and stabilizing the pelvis 206 with the support padding, the spine 208 is forced to round forward eliminating lordosis/kyphosis or lumbar curve, i.e., painful slouching of the spine 208. It is also significant to note that a substantial amount of the support for the lower back 204 is achieved on the seat 102 and the support padding 112.

As discussed above, the assembly 100 also enables mobility and steering. At least one wheel 126*a-b*, 128*a-b* at the frame 120 is configured to enable mobility of the assembly. The wheels 126*a-b*, 128*a-b* may roll forward, backwards, or rotate 360°. At least one brake 130*a-b* is configured to at least partially restrict movement of the at least one wheel. With the brake 130*a-b* applied and the seat 102 inhibited from rotation, the feet may manipulate the frame 120 and the brackets 132, 134 to steer the assembly 100.

In one exemplary embodiment, shown in FIG. 1, at least one forward wheel 126*a-b* and at least one rear wheel 128*a-b* operatively connect to the frame 120 to enable mobility. At least one brake 130*a-b* may position at any of the wheels 126*a-b*, 128*a-b* to restrict movement thereof. The wheel 126*a-b*, 128*a-b* may include a castor wheel. The brake 130*a-b* may include a friction lever that squeezes against the wheel 126*a-b*, 128*a-b* to inhibit rotation thereof.

As discussed above, the first bracket 132 and the second bracket 134 extend across the frame 120 in an arc shape to provide structural integrity, anti-tip capacity, steering capacity, and weight balance. The brackets 132, 134 and the wheels 126*a-b*, 128*a-b* are configured to enable the calf of the users left and right leg to brace against for steering and anchoring the assembly 100. In one alternative embodiment, the frame 120 can have lateral hideaway forks or plates for resting and ferrying heavy cargo while the user propels and brakes with his feet as the calves of the legs steer during transit.

Figure 2:
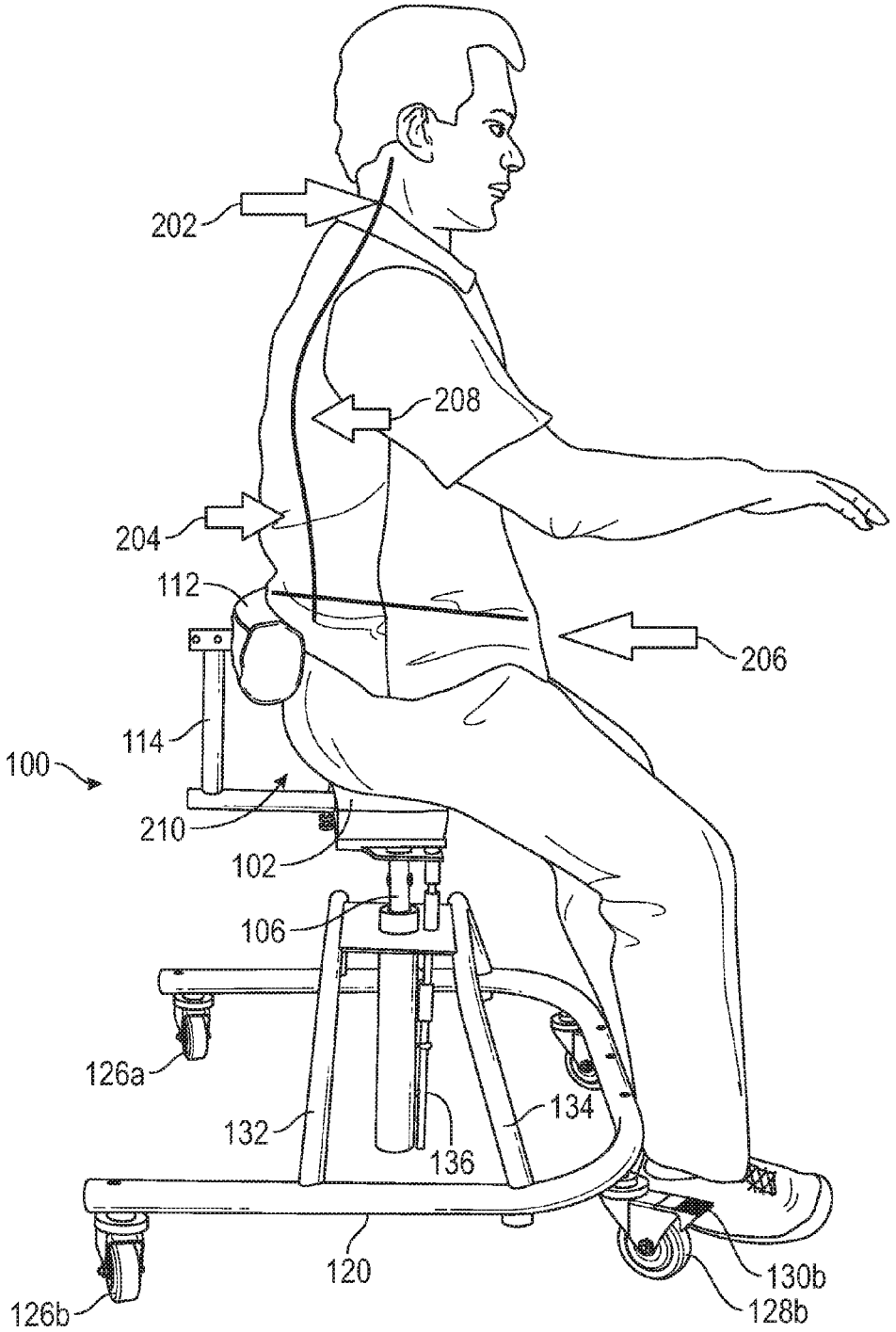
FIG. 2 illustrates a perspective view of a user sitting in a slouched working position on a standard ergonomic chair, causing the spine to curve, in accordance with an embodiment of the present invention.

Those skilled in the art, in light of the present teachings, will recognize that a standard ergonomic chair is not always conducive to maintaining a proper posture while sitting at a workstation, walking between workstations, or picking up objects. Consequently, the spine 208 may not be forced into the proper alignment. This is problematic because the spine 208 has a proclivity to relax in a slightly slouched position, and consequently, the pelvic tilts forward, as shown in FIG. 2. The curved nature of the spine 208 in this slouched position may create stress on the lower back 204 and the neck 202, especially after long durations and repetitive movements at the workstation. After a duration, this may result in spinal problems, lower back 204 pain, sciatic nerve pain, general neck 202 and spine 208 pain, and sore legs—conditions that are not conducive to productivity and time at the workstation.

The assembly 100 helps alleviate the spinal problem by stabilizing and tilting the pelvis 206, and adjustably tilting, raising, and lowering the seat 102, such that the pelvis 206 snugly abuts the support padding 112. This anatomical positioning of the pelvis 206 causes the user to bend the spine 208 over the pelvic pad and this forces open the posterior intervertebral spacing along the spine 208. This provides a comfortable support to the lower back 204 while the user is in a sitting or standing position while also alleviating body weight loading on all lower extremities.

Figure 7:
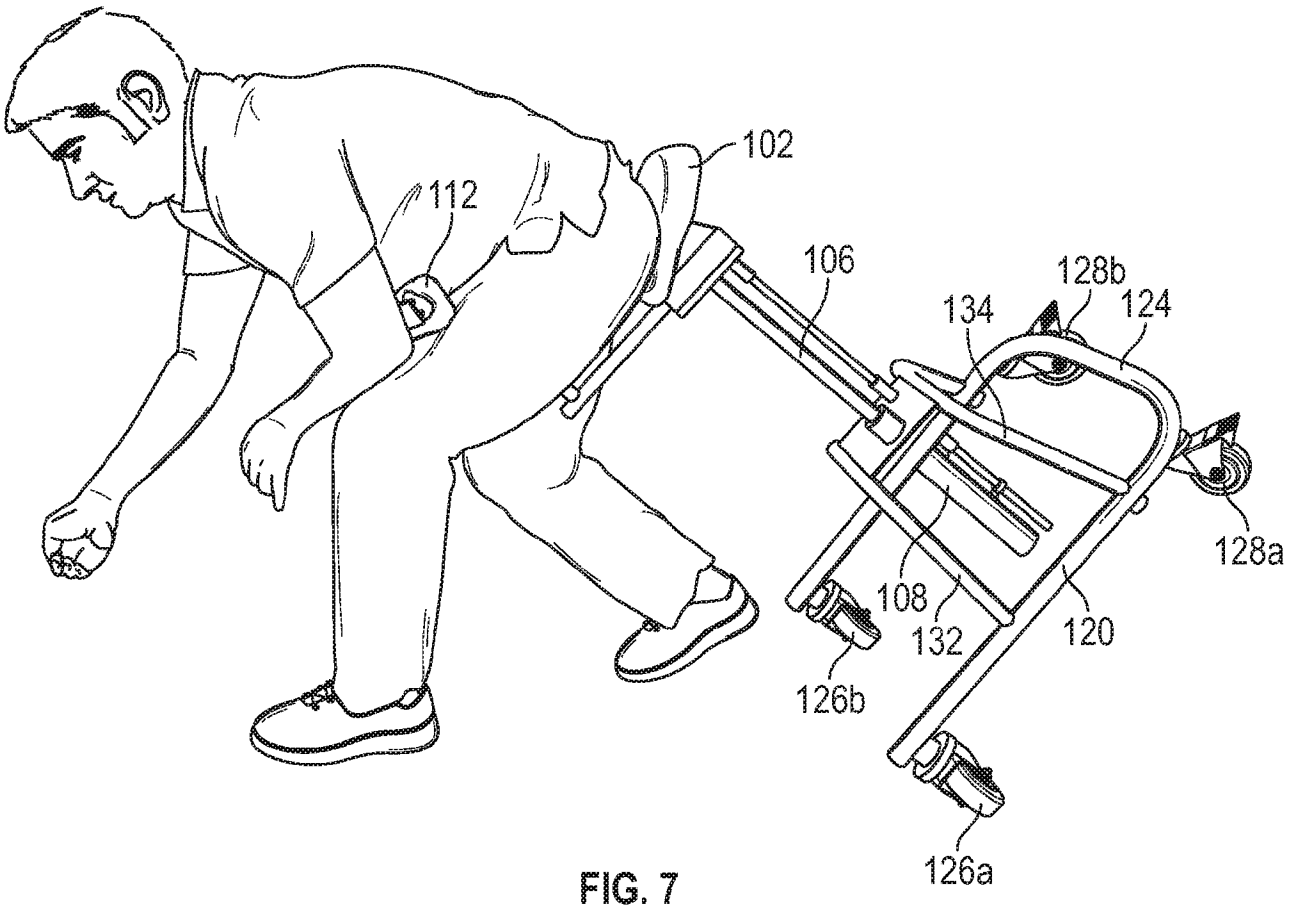
FIG. 7 illustrates a perspective view of a user reaching to the floor showing the invention attached but allowing the reach to access the floor even to tie a shoe, in accordance with an embodiment of the present invention.

The assembly 100 is also unique in that it remains attached to the user while the user walks, kneels, and picks up an object (FIGS. 5 and 7). Because the user's buttocks 210 remain engaged on the seat 102, and the seat 102 tilts forward to press the user's pelvis 206 against the support padding 112, the assembly 100 remains attached to the user while the user walks, kneels, and picks up an object. Also, in the standing, walking, kneeling, or lifting position, the weight of the user and/or object is carried substantially by the adjustable rod 106 that supports the seat 102

Figure 3:
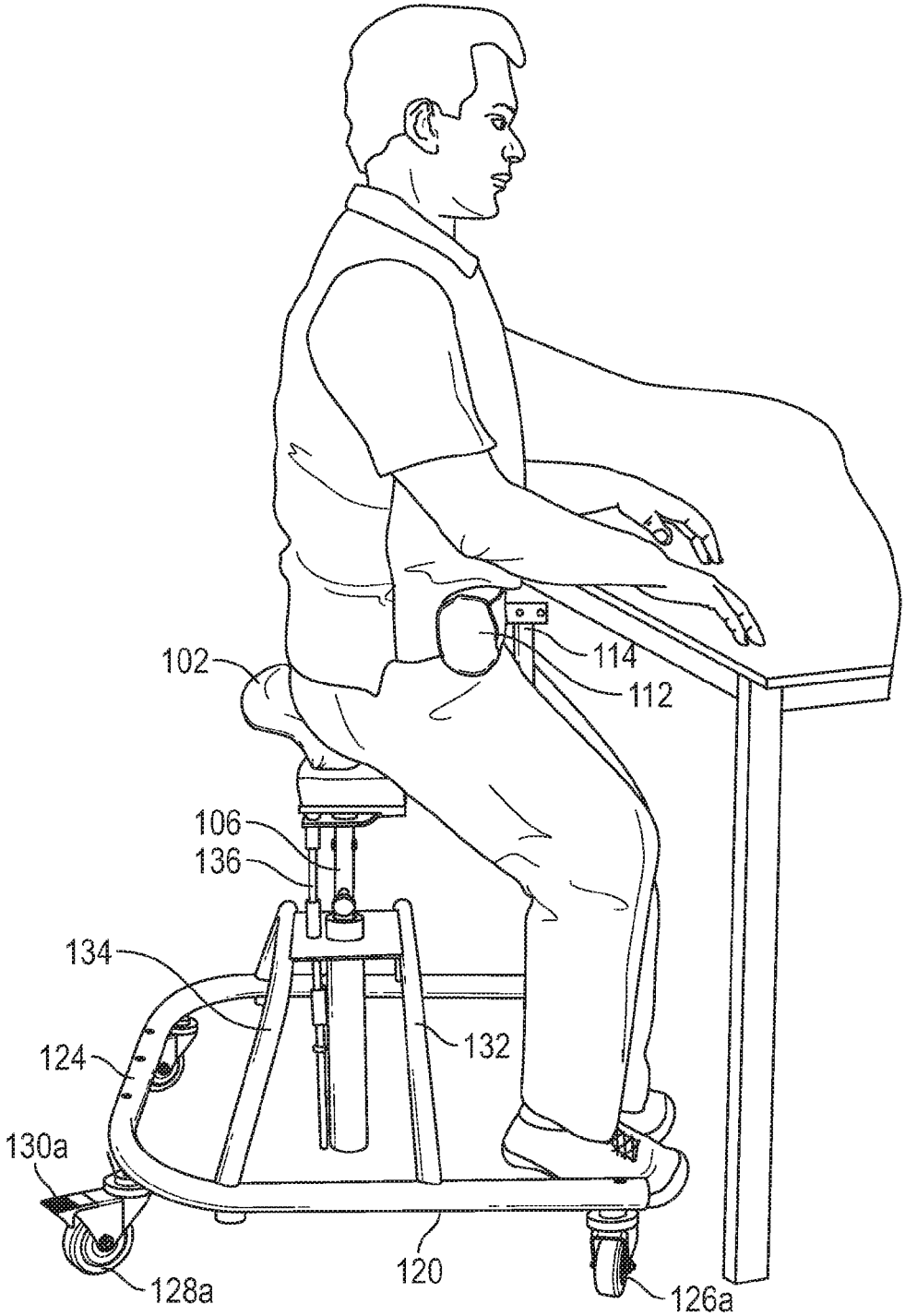
FIG. 3 illustrates a perspective view of a user sitting in the ergonomic chair assembly, in accordance with an embodiment of the present invention.

In operation, the assembly 100 may be used in a sitting, standing, crawling, or lifting capacity. Turning now to FIG. 3, the seat 102 is configured to rest parallel with the ground surface and adjust in height to conform to a user's size and comfort level. The seat 102 engages the ischium region of the pelvis 206 and the buttocks 210 to support a substantial portion of the weight of the user and/or an object. In one embodiment, the adjustable configuration of the seat 102 allows the assembly 100 to function as an ergonomic chair for a user in a sitting or standing position. In the sitting position, the seat 102 carries the full weight of the user. In the standing position, the seat 102 carries up to 100% of the weight of the user and/or an object.

Figure 4:
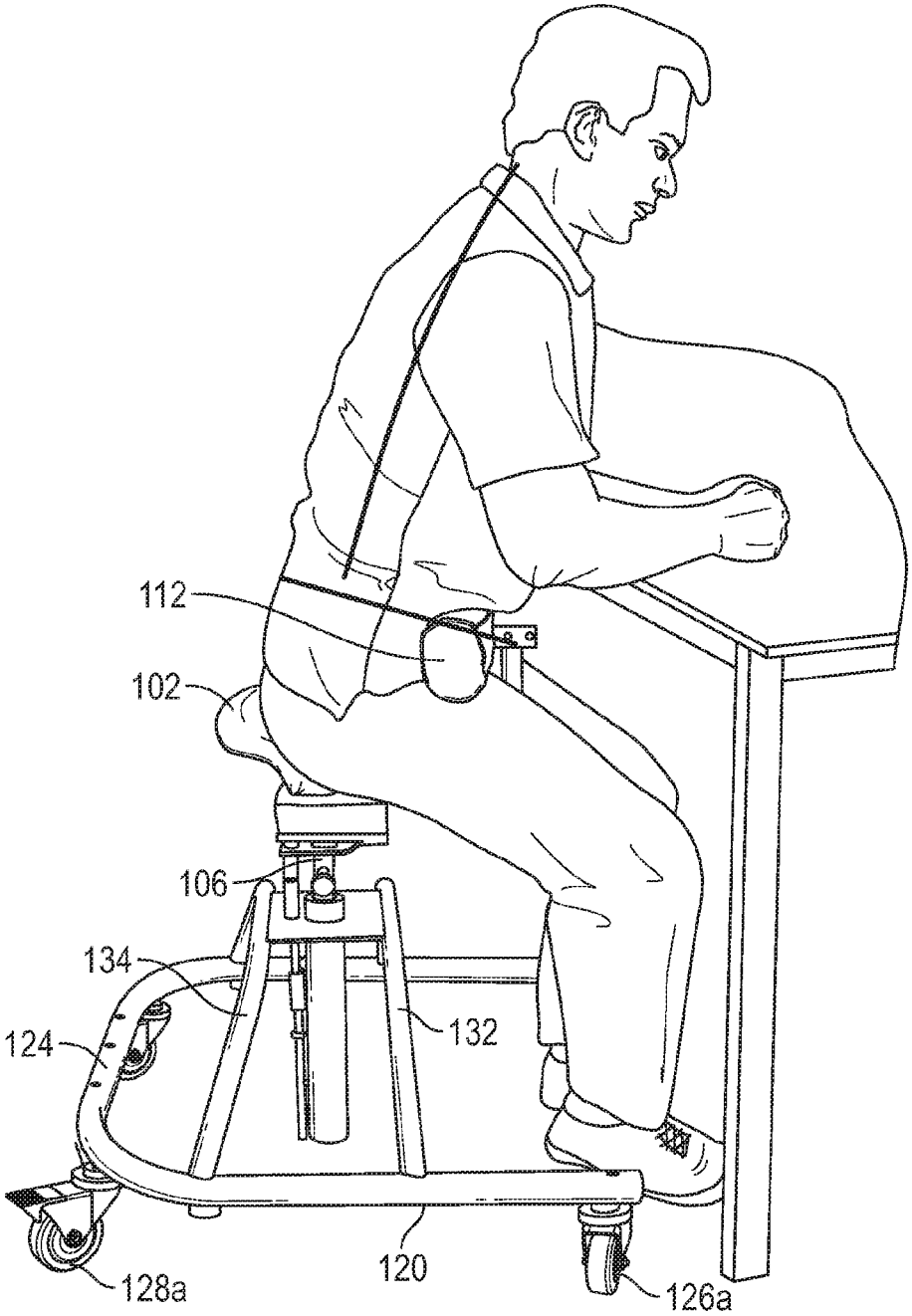
FIG. 4 illustrates a perspective view of a user sitting in the ergonomic chair assembly, with the spine generally aligned to open posterior intervertebral spacing and the pelvis tilted forward, in accordance with an embodiment of the present invention.

Looking now at FIG. 4, the seat 102 is configured to tilt up to 35° in the forward direction, towards the support padding 112. A fulcrum may enable tilting of the seat 102 to the desired position. A seat lock 104 may fasten the seat 102 at the desired tilted position. In some embodiments, the seat 102 is tilted forward until the pelvis 206 of the user abuts the support padding 112. The support padding 112 may be padded to help alleviate discomfort to the pelvis 206.

As described above, the support padding 112 is fixedly disposed forward of a user, such that the support padding 112 forms a comfortable support for the pelvis 206. A support bracket 114 that extends from the frame 120 may support the support padding 112. The support bracket 114 may be defined by a proximal end 116 that fixedly attaches to the closed end 124 of the frame 120, and a distal end 118 that fastens to the support padding 112. In one alternative embodiment, the distal end 118 of the support bracket 114 is configured to enable the support padding 112 to pivot slightly for user comfort.

By tilting the seat 102 forward, the pelvis 206 is carried forward to directly engage the support padding 112, on the iliac crest or hip bones. FIG. 4 illustrates the generally straight positioning of the spine 208 that the support padding 112 forces while the user sits in a typical workstation working position. It is significant to note the significant tilted orientation of the seat 102, which may be up to 35°. A tilt lever is accessible beneath the seat 102 to enable tilting the seat 102 forward or returning the seat 102 to the horizontal position. It is significant to note that by stabilizing the pelvis 206 and tilting it forward at the ideal 32°, the spine 208 is forced to round forward over the pelvic support. This creates a different ergonomic experience to standard chairs.

In operation, the seat 102 is height and tilt adjusted such that the pelvis 206 firmly abuts the support padding 112. The adjustability of the seat 102 tilts the pelvis 206 forward to maintain contact with the support padding 112. This anatomical positioning of the pelvis 206 creates uniform intervertebral spacing along the spine 208, which provides a comfortable support to the lower back 204 by opening compressed posterior disc space while the user is in a sitting or standing position.

In another operational embodiment, the user may stand while remaining attached to the assembly 100. For example, the user may move between multiple workstations and sit to work for a duration at each workstation while the assembly 100 remains attached. In the standing position, the seat 102 maintains engagement with the buttocks 210 and the ischium region of the pelvis 206, and the support padding 112 maintains engagement with the pelvis 206. The tilted position of the seat 102 is such that sufficient pressure maintains the assembly 100 in attachment to the user. Thus, the user may also kneel or pick up an object while the assembly 100 is attached in this manner.

Figure 8:
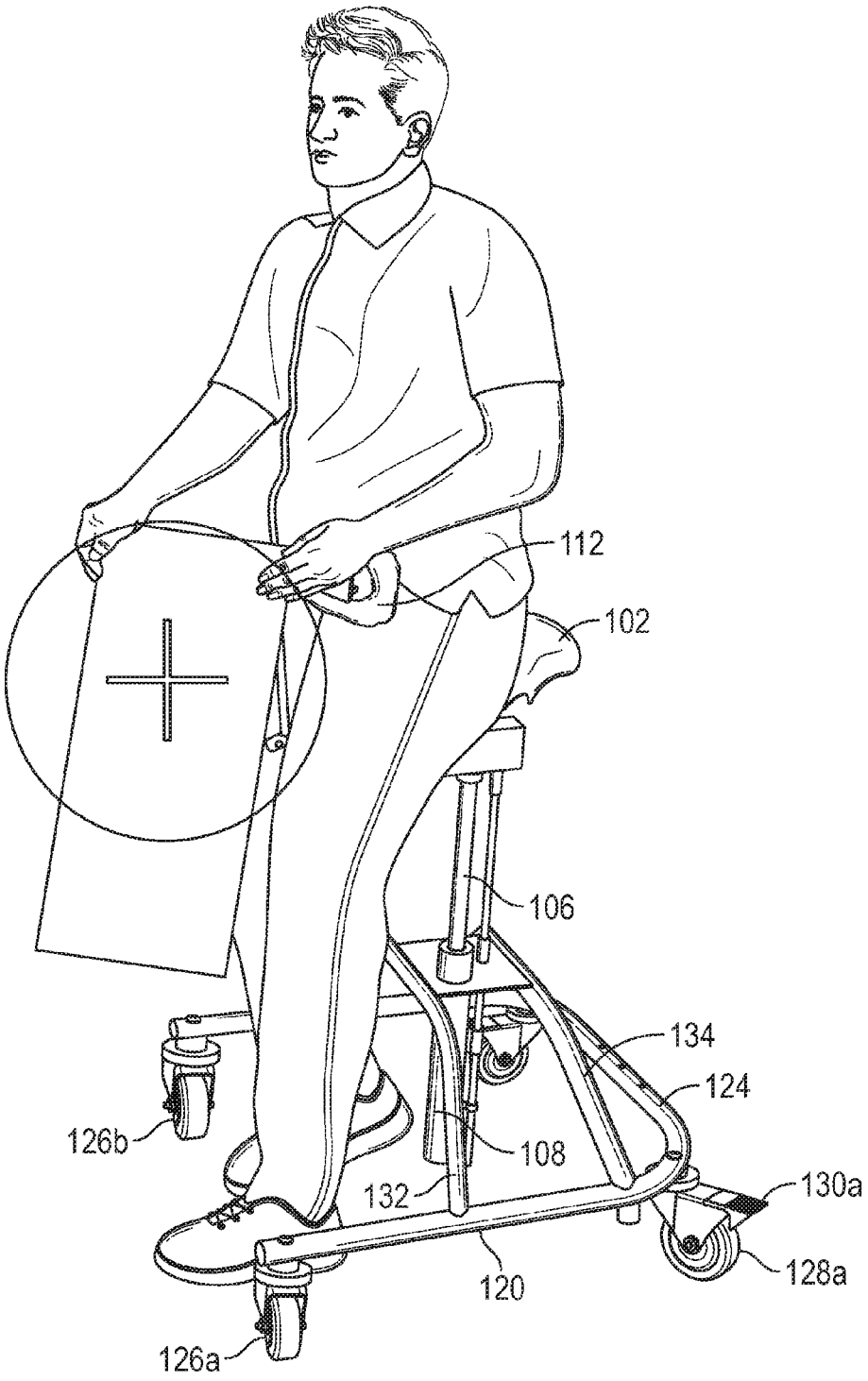
FIG. 8 illustrates a perspective view of a user picking up an object with an attached ergonomic workstation assembly supporting a substantial portion of the user's weight and object's weight, in accordance with an embodiment of the present invention.

Turning now to FIG. 8, the assembly 100 is effective for enabling the user to pick up an object with minimal stress to the back and alleviation of weight from the legs. This is possible because the seat 102 maintains engagement with the buttocks 210 and the ischium region of the pelvis 206, and the support padding 112 maintains engagement with the pelvis 206. The tilted position of the seat 102 is such that sufficient pressure maintains the assembly 100 in attachment to the user. Thus, the user may also walk or pick up an object while the assembly 100 is attached, and consequently, the spine 208 is generally straight. The adjustable rod 106 that supports the seat 102 also helps to absorb much of the weight of the object. In one embodiment, the assembly 100 may use laterally placed forks or plates for holding cargo for transport. Additional plates may be mounted on assembly 100 to allow the user 2 or 3 steps for use as a step ladder.

Figure 9:
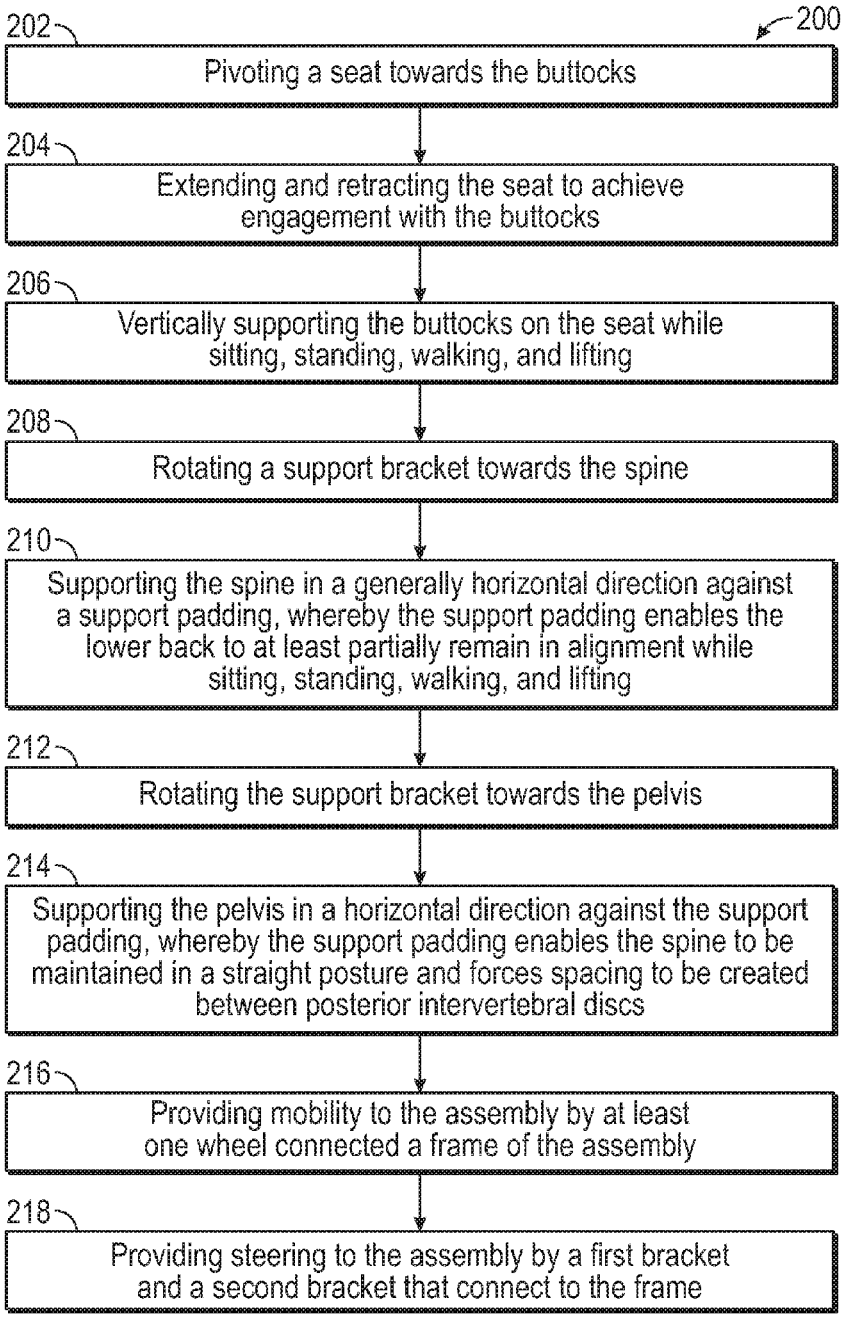
FIG. 9 illustrates a flowchart diagram of an exemplary method of operating a mobile body unweighted sit and stand chair assembly, in accordance with an embodiment of the present invention.

FIG. 9 illustrates a flowchart diagram of an exemplary method 200 of operating a mobile body unweighted sit and stand chair assembly 100. The method 200 comprises an initial Step 202 of pivoting a seat 102 towards the buttocks 210. A Step 204 may include extending and retracting the seat 102 to achieve engagement with the buttocks 210. The seat 102 pivotally rests on an adjustable rod 106, and extends and retract in accordance with the adjustable rod 106.

In some embodiments, a Step 206 may include vertically supporting the buttocks 210 on the seat 102 while sitting, standing, walking, and lifting. Thus, the seat 102 is vertically, rotatably, and pivotally adjustable, and supports the buttocks 210. A Step 208 comprises rotating a support bracket 114 towards the spine 208. The support bracket 114 rotates about an adjustable rod 106. A Step 210 includes supporting the spine 208 in a generally horizontal direction against a support padding 112, whereby the support padding 112 enables the lower back 204 to at least partially remain in alignment while sitting, standing, walking, and lifting.

In some embodiments, a Step 212 may include rotating the support bracket 114 towards the pelvis 206. A Step 214 comprises supporting the pelvis 206 in a generally horizontal direction against the support padding 112, whereby the support padding 112 enables the spine 208 to be at least partially maintained in a straight posture and forces spacing to be created between the posterior intervertebral discs. The support padding 112 may also be pivoted up to 35° to provide additional support and comfort. A Step 216 may include providing mobility to the assembly by at least one wheel 126*a-b*, 128*a-b* connected a frame 120 of the assembly 100.

A final Step 218 comprises providing steering to the assembly 100 by a first bracket 132 and a second bracket 134 that connect to the frame 120. The first bracket 132 and the second bracket 134 extend across the frame 120 at specific angles to provide structural integrity, anti-tip capacity, steering capacity, and weight balance. The brackets 132, 134 and the wheels 126*a-b*, 128*a-b* are configured to enable the calf of the users left and right leg to brace against for steering and anchoring the assembly 100.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A mobile body unweighted sit and stand chair assembly, the assembly comprising:

a frame, the frame defined by a substantially U-shape having a closed end and an open end;

a first bracket configured to traverse the closed end of the frame, the first bracket configured to at least partially brace the assembly for steering;

a second bracket configured to traverse the open end of the frame, the second bracket configured to at least partially brace the assembly for steering;

an adjustable rod, the adjustable rod defined by a mount end and a seat end, the adjustable rod disposed in a generally perpendicular relationship with the frame, the adjustable rod configured to extend and retract relative to the frame, the adjustable rod further configured to rotate about an axis;

a seat, the seat configured to join the seat end of the adjustable rod, the seat further configured to pivot about the seat end of the adjustable rod, whereby the seat is configured to extend, retract, pivot, and rotate;

a restriction bar, the restriction bar disposed in a generally perpendicular relationship with the frame, the restriction bar further disposed in a generally parallel relationship with the adjustable rod, the restriction bar configured to selectively restrict rotation of the adjustable rod about the axis, whereby restricting rotation of the adjustable rod restricts rotation of the seat;

a support bracket, the support bracket defined by a generally L-shape having a proximal end and a distal end, the proximal end configured to join with the seat end of the adjustable rod, the support bracket further configured to extend and retract relative to the adjustable rod, the support bracket further configured to rotate about the axis of the adjustable rod;

a support padding, the support padding configured to join with the distal end of the support bracket, the support padding further configured to pivot about the distal end of the support bracket, whereby the support padding is configured to pivot and rotate about the axis of the adjustable rod;

at least one wheel, the at least one wheel configured to enable mobility of the assembly; and at least one brake, the at least one brake configured to at least partially restrict movement of the at least one wheel, the at least one brake configured to at least partially brace the assembly for steering.

2. The assembly of claim 1, wherein the frame, first bracket, and the second bracket are configured to brace the assembly, so as to enable the lower body to steer the assembly.

3. The assembly of claim 1, wherein the closed end of the frame comprises a pair of parallel bars separated by a gap.

4. The assembly of claim 1, wherein the first bracket has a generally arced shape.

5. The assembly of claim 1, wherein the second bracket has a generally arced shape.

6. The assembly of claim 1, further including a bridge, the bridge configured to connect the first bracket and the second bracket.

7. The assembly of claim 6, wherein the mount end of the adjustable rod is configured to pass through the bridge.

8. The assembly of claim 7, wherein the restriction bar is configured to pass through the bridge.

9. The assembly of claim 1, wherein restriction of rotation of the seat by the restriction bar helps brace the assembly, so as to enable lower body to steer the assembly.

10. The assembly of claim 1, further including a locking tube.

11. The assembly of claim 10, wherein the locking tube is configured to receive the adjustable rod.

12. The assembly of claim 11, wherein adjustable tube and the locking tube form a gas spring rod.

13. The assembly of claim 1, wherein the at least one wheel comprises two wheels at the closed end of the frame and two wheels at the open end of the frame.

14. The assembly of claim 1, wherein the at least one wheel is a castor wheel.

15. The assembly of claim 1, further including a control plate, the control plate configured to regulate extension and retraction of the adjustable rod.

16. A mobile body unweighted sit and stand chair assembly, the assembly comprising:

a frame, the frame defined by a substantially U-shape having a closed end and an open end;

a first bracket configured to traverse the closed end of the frame, the first bracket configured to at least partially brace the assembly for steering;

a second bracket configured to traverse the open end of the frame, the second bracket configured to at least partially brace the assembly for steering;

a bridge configured to connect the first bracket and the second bracket;

an adjustable rod, the adjustable rod defined by a mount end and a seat end, the adjustable rod disposed in a generally perpendicular relationship with the frame, the adjustable rod configured to extend and retract relative to the frame, the adjustable rod further configured to rotate about an axis;

a locking tube, the locking tube configured to receive the adjustable rod;

a control plate, the control plate configured to regulate extension and retraction of the adjustable rod;

a seat, the seat configured to join the seat end of the adjustable rod, the seat further configured to pivot about the seat end of the adjustable rod, whereby the seat is configured to extend, retract, pivot, and rotate;

a restriction bar, the restriction bar disposed in a generally perpendicular relationship with the frame, the restriction bar further disposed in a generally parallel relationship with the adjustable rod, the restriction bar configured to selectively restrict rotation of the adjustable rod about the axis, whereby restricting rotation of the adjustable rod restricts rotation of the seat;

a support bracket, the support bracket defined by a generally L-shape having a proximal end and a distal end, the proximal end configured to join with the seat end of the adjustable rod, the support bracket further configured to extend and retract relative to the adjustable rod, the support bracket further configured to rotate about the axis of the adjustable rod;

a support padding, the support padding configured to join with the distal end of the support bracket, the support padding further configured to pivot about the distal end of the support bracket, whereby the support padding is configured to pivot and rotate about the axis of the adjustable rod;

at least one wheel, the at least one wheel configured to enable mobility of the assembly; and at least one brake, the at least one brake configured to at least partially restrict movement of the at least one wheel, the at least one brake configured to at least partially brace the assembly for steering.

17. The assembly of claim 16, wherein the frame, first bracket, and the second bracket are configured to brace the assembly, so as to enable lower body to steer the assembly.

18. The assembly of claim 16, wherein restriction of rotation of the seat by the restriction bar helps brace the assembly, so as to enable lower body to steer the assembly.

19. The assembly of claim 16, wherein the first bracket and the second bracket have a generally arced shape.

* * * * *